United States Patent [19]

Gerber et al.

[11] Patent Number: 4,499,750

[45] Date of Patent: Feb. 19, 1985

[54] DRAWING DEVICE FOR PRESSES WITH MECHANICALLY DRIVEN DRAWING RAM

[75] Inventors: Heinz Gerber, Göpp.-Jebenhausen; Klaus Adam, Waghäusel; Heinz Horn, Oberhausen, all of Fed. Rep. of Germany

[73] Assignee: L. Schuler GmbH, Fed. Rep. of Germany

[21] Appl. No.: 525,906

[22] PCT Filed: Sep. 7, 1982

[86] PCT No.: PCT/DE82/00181

§ 371 Date: May 9, 1983

§ 102(e) Date: May 9, 1983

[87] PCT Pub. No.: WO83/00821

PCT Pub. Date: Mar. 17, 1983

[51] Int. Cl.[3] ..... B21D 22/00

[52] U.S. Cl. ..... 72/351; 72/349

[58] Field of Search ..... 72/347, 348, 349, 344, 72/345, 350, 351

[56] References Cited

U.S. PATENT DOCUMENTS

| | | | |
|---|---|---|---|
| 1,550,626 | 8/1925 | Nelson . | |
| 1,884,700 | 10/1932 | Hothersall . | |
| 3,296,850 | 1/1967 | Fiore | 72/351 |
| 3,453,848 | 9/1969 | Williamson | 72/351 |
| 3,456,478 | 7/1969 | Alexander | 72/351 |
| 3,460,500 | 8/1969 | McCoy | 72/351 |
| 3,636,748 | 1/1972 | Hall et al. | 72/349 |
| 3,817,076 | 6/1974 | Wallace | 72/351 |
| 3,967,482 | 7/1976 | Kubacki et al. | 72/345 X . |

FOREIGN PATENT DOCUMENTS

| | | |
|---|---|---|
| 73020 | 12/1970 | Fed. Rep. of Germany . |
| 1097681 | 7/1955 | France . |

*Primary Examiner*—Leon Gilden

*Attorney, Agent, or Firm*—Craig and Burns

[57] ABSTRACT

In a drawing device for presses with a mechanically driven drawing ram (24) and with a sheet metal holder (5) exerting its holding force, acting on the metal sheet (27) and counteracting the drawing direction, by way of a pressure plate (7) by means of a die cushion piston (10), supporting the pressure plate and being under the effect of a pressure medium, in a fixed die cushion cylinder (12), the objective consists in avoiding, or at least reducing, the noise-generating impact shock upon impingement of the drawing ram (24) on the sheet metal holder (5) with the metal sheet (27) lying thereon.

This objective has been attained by mounting to the pressure plate (7) a piston (9) with a working surface exposable in the drawing direction, and by providing a control means (22, 23) operating in dependence on the ram stroke, this control means making it possible, before placing the drawing ram (24) on the sheet metal holder (5), to accelerate the latter, by exposing the working surface to a pressure medium, toward a movement in the drawing direction, the velocity of this movement being equal to or not much lower than the velocity of the drawing ram (24) upon impingement on the sheet metal holder (5).

4 Claims, 1 Drawing Figure

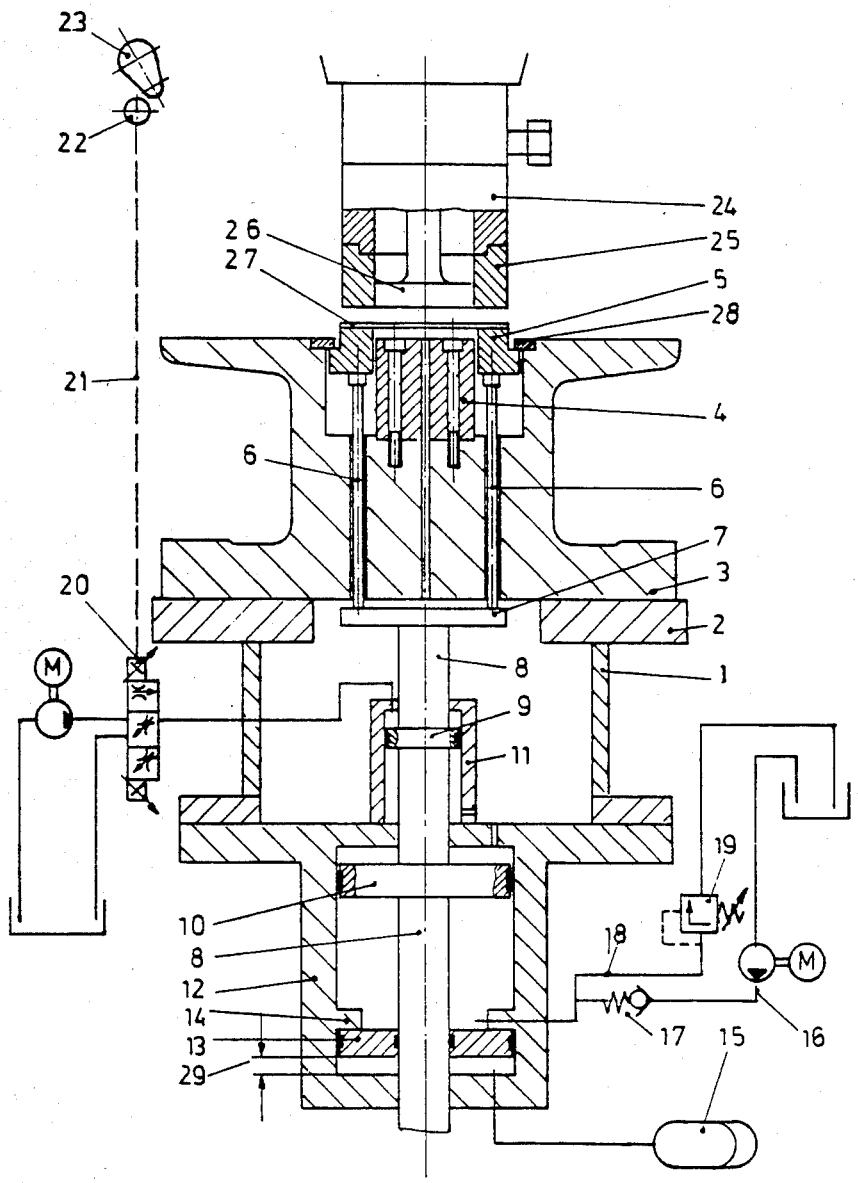
23
22
24
26
25
27
5
28
21
4
6
6
7
3
20
2
M
8
1
9
11
19
10
8
18
M
12
14
17
15
16
13
29

DRAWING DEVICE FOR PRESSES WITH MECHANICALLY DRIVEN DRAWING RAM

The invention relates to a drawing device for presses with mechanically driven drawing ram and with a sheet metal holder exerting its holding force, acting on the sheet metal and counteracting the drawing direction, by way of a pressure plate by means of a die cushion piston, supporting the pressure plate and being under the effect of a pressure medium, in a fixed die cushion cylinder.

During the working stroke of the drawing ram of such a press, the sheet metal is first urged by the drawing die against the sheet metal holder and is subsequently shifted together therewith against the pressure force acting in the die cushion cylinder; during this step, the sheet metal held between the sheet metal holder and the drawing die is deformed at the same time by the drawing punch of the tool fixedly mounted on the press platen. The drawing ram shifts the sheet metal holder against the pressure force acting on the die cushion piston, the drawing ram having to overcome additionally the force of the mass moment of inertia caused by the acceleration of the movable sheet metal holder and die cushion masses. The sheet metal holder, supported on the die cushion piston, forms in this arrangement a rigid system with a large, coherent mass that must be suddenly accelerated from the rest position to the impact velocity of the drawing ram. If the sheet metal holder force is produced hydraulically in the die cushion, then the force of the mass moment of inertia of the pressure fluid must be additionally overcome during acceleration of the system at rest.

In a conventional drawing device of the type discussed above (German Pat. No. 1,452,943), a resilient member is disposed between the sheet metal holder and the movable masses of the die cushion. Thereby the movable mass of the die cushion is accelerated, as seen in time, after the mass of the sheet metal holder so that the forces of inertia of the entire system are not cumulative. The resilient member effects a constant increase in velocity of the die cushion piston up to the velocity of the drawing ram. The effective force of the mass moment of inertia of the die cushion piston is reduced by this constant velocity increase of the die cushion piston. Yet, the drawing ram, with its velocity given within this range of movement, hits the sheet metal disposed, at rest, on the sheet metal holder so that an undamped impact results.

It is an object of the invention to avoid this impact shock in a drawing device of the type described above, or at least to reduce such impact shock.

This feature has been attained according to this invention by providing that a piston having a working surface which is acted upon in the drawing direction is attached to the pressure plate; and that a control means operating in dependence on the ram stroke is included making it possible to accelerate the sheet metal holder, before the drawing ram comes into contact with the latter, by exposing the working surface to a pressure medium, to a movement in the drawing direction.

On account of these measures, the sheet metal holder with the sheet metal lying thereon is already in motion in the drawing direction when the drawing ram impinges on the sheet metal; the relative velocity between drawing ram and sheet metal is thus lower than in case of an impingement on the stationary sheet metal. The impact shock is thereby mitigated or entirely avoided.

An especially simple constructional design of the drawing device is obtained if the working surface is formed at the die cushion piston.

An especially sensitive adaptation of the sheet metal holder movement to the drawing ram movement can be attained by providing that the control means influences the exposure of the working surface to pressure medium by way of a proportional valve.

Advantageously, the movement of the sheet metal holder in the drawing direction can be accelerated to a speed equal to or not much lower than the speed of the drawing ram when impinging on the sheet metal holder.

It is therefore an object of the invention to produce an improved drawing device for presses with mechanically driven drawing rams.

Another object of the invention is to avoid impact shock in a drawing device for mechanically driven drawing rams.

It is another object of the invention to reduce impact shock by providing a piston having a working surface which is acted upon in the drawing direction attached to a pressure plate, a control means operating in dependence upon the ram stroke being included to make it possible to accelerate a sheet metal holder, before the drawing ram comes into contact with the latter, by exposing the working surface to a pressure medium to a movement in the drawing direction.

A further object of the invention is to produce a drawing device for presses with a mechanically driven drawing ram and with a sheet metal holder means exerting its holding force, acting on the metal sheet and counteracting the drawing direction, by way of a pressure plate by means of a die cushion piston supporting the pressure plate and being under the effect of a pressure medium, in a fixed die cushion cylinder and having a piston means having a working surface acted upon in the drawing direction and attached to the pressure plate with a control means operating in dependence on the ram stroke which makes it possible before placing the drawing ram on the sheet metal holder means to accelerate the sheet metal holder means in the drawing direction by exposing the working surface to a pressure medium.

It is another object of the invention to provide a drawing device for presses with a mechanically driven drawing ram wherein noise-generating impact shock upon impingement of the drawing ram on the sheet metal holder is reduced.

It is another object of the invention to accelerate the movement of a sheet metal holder in a drawing device for presses to a velocity equal to or approaching the velocity of the drawing ram just prior to impingement of the drawing ram on the sheet metal holder.

These and other objects, features, and advantages of the present invention will become more apparent from the following description when taken in connection with the accompanying drawing which shows, for the purposes of illustration only, one embodiment in accordance with the present invention, and wherein the figure shows in an underframe 1 of a press—not illustrated in detail in the drawing—a bottom tool 3 with a fixed drawing punch 4 and with a sheet metal holder 5 movable in the drawing direction is arranged on a press platen 2. The sheet metal holder 5 is supported by way of ejector pins 6 on a pressure plate 7 which latter is mounted to the upper end of a piston rod 8; a piston 9 and a die cushion piston 10 are rigidly attached to this rod. The piston 9 is guided within a cylinder 11 fixedly mounted to the frame and has a top working surface which can be acted upon in the drawing direction. The die cushion piston 10 is guided within a die cushion cylinder 12 fixedly mounted to the frame; in the lower zone of this cylinder, a ring piston 13 surrounding the piston rod 8 is additionally guided. The movements of this ring piston are limited in the drawing directly downwardly by the end wall of the die cushion cylinder 12 and upwardly by an internal annular collar 14 at the die cushion cylinder 12.

A bubble storage means 15 is connected to the pressure medium chamber formed underneath the ring piston 13 in the die cushion cylinder 12. A pressure medium feed conduit 16 is connected via a check valve 17 to the pressure medium chamber formed underneath the die cushion piston 10 in the die cushion cylinder 12 above the annular collar 14, and a pressure medium discharge conduit 18 is connected to this same pressure medium chamber by way of a pressure limiting valve 19. A pressure medium feed and discharge conduit is connected by way of a switchable valve 20 to the pressure medium chamber formed in cylinder 11 above piston 9. The valve 20 is connected, via an operative connection 21, to a control means dependent on the ram stroke, comprising of a cam follower 22 and a cam 23, which latter revolves synchronously with a mechanical drive mechanism—not shown in the drawing—for a drawing ram 24. The drawing ram 24 carries on its underside a drawing die 25, located in opposition to the sheet metal holder 5, and an ejector 26, lying in opposition to the drawing punch 4.

An operating cycle of the drawing device begins in the starting position—illustrated in the drawing—wherein a metal sheet 27 rests on the sheet metal holder 5, which latter is in its highest position wherein it is in contact from below with a collar 28 of the bottom tool 3. The drawing ram 24 begins its downward movement. Before the drawing die 25 comes into contact with the metal sheet 27, the control means 22, 23, exposes the working surface on the topside of piston 9 to pressure medium so that the piston rod 8, with all parts attached thereto, and the sheet metal holder 5 are accelerated in the drawing direction. During this acceleration, the sheet metal holder 5 drops, with the metal sheet 27 disposed thereon, to such an extent that the topsides of the sheet metal holder 5 and of the bottom tool 3 are at the same level and the metal sheet 27 rests on the drawing punch 4. By then, the drawing ram 24 with the drawing die 25, moving faster in the drawing direction, has also reached the topside of the metal sheet 27. During the acceleration, the pressure medium entrapped in the pressure medium chamber underneath the die cushion piston 10 has furthermore shifted the ring piston 13 by its stroke 29 up to its abutment against the lower end wall of the die cushion piston 12. The stroke 29 is equal to the extent by which the sheet metal holder 5 projects, in its highest position, with its topside past the topside of the bottom tool 3. With the contacting of the drawing die 25 against the metal sheet 27 and the abutting of the ring piston 13 against the lower end wall of the die cushion cylinder 12, the drawing device starts operation in the usual way as a hydraulic drawing mechanism. After the drawing stroke has been completed, the drawing device returns to the starting position—illustrated in the drawing.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

What is claimed is:

1. A drawing device for a press for a metal sheet, the press having a mechanically driven drawing ram and with a sheet metal holder means exerting its holding force, acting on the metal sheet and counteracting the drawing direction, by way of a pressure plate by means of a die cushion piston, supporting the pressure plate and being under the effect of a pressure medium, in a fixed die cushion cylinder, comprising a piston means having a working surface acted upon in the drawing direction and attached to the pressure plate, and a control means operating in dependence on the ram stroke for exposing the working surface to a pressure medium to accelerate the sheet metal holder means in the drawing direction before placing the drawing ram on the metal sheet and sheet metal holder means.

2. A drawing device according to claim 1, wherein the working surface is formed at the die cushion piston in the die cushion cylinder.

3. A drawing device according to claim 1, further comprising proportional valve means for causing the control means to influence the exposure of the working surface with pressure medium.

4. A drawing device according to claim 1, wherein the control means causes the movement of the sheet metal holder to be accelerated in the drawing direction to one of a velocity equal to and a velocity not much lower than the velocity of the drawing ram upon impingement on the sheet metal holder.

* * * * *